US010335921B1

(12) United States Patent
Chung

(10) Patent No.: US 10,335,921 B1
(45) Date of Patent: Jul. 2, 2019

(54) CONTINUOUS SHOT PEENING APPARATUS AND METHOD FOR COIL SPRING

(71) Applicant: DAEWON APPLIED ENG. CO., Siheung-si (KR)

(72) Inventor: Chan-Ki Chung, Incheon (KR)

(73) Assignee: DAEWON APPLIED ENG. CO., Siheung-si (KR)

( * ) Notice: Subject to any disclaimer, the term of this patent is extended or adjusted under 35 U.S.C. 154(b) by 0 days.

(21) Appl. No.: 15/663,573

(22) Filed: Jul. 28, 2017

Related U.S. Application Data

(63) Continuation of application No. PCT/KR2016/014696, filed on Dec. 15, 2016.

(30) Foreign Application Priority Data

Jun. 9, 2016 (KR) ..... 10-2016-0071455

(51) Int. Cl.
*B24C 1/10* (2006.01)
*B24C 3/32* (2006.01)
*B24C 3/20* (2006.01)

(52) U.S. Cl.
CPC ..... *B24C 1/10* (2013.01); *B24C 3/20* (2013.01); *B24C 3/32* (2013.01)

(58) Field of Classification Search
None
See application file for complete search history.

(56) References Cited

U.S. PATENT DOCUMENTS

2011/0053471 A1* 3/2011 Jung ..... B24C 1/10 451/80

FOREIGN PATENT DOCUMENTS

| | | | |
|---|---|---|---|
| CN | 101301729 | A | 11/2008 |
| CN | 105377508 | A | 3/2016 |
| JP | 1981-107880 | A | 8/1981 |
| JP | 07-251375 | | 10/1995 |
| JP | 2003-117830 | | 4/2003 |
| KR | 10-0807148 | | 3/2008 |
| KR | 10-093115 | B | 12/2009 |
| KR | 10-1116808 | B | 2/2012 |
| KR | 10-1229920 | | 2/2013 |
| KR | 10-2013-0051604 | A | 5/2013 |
| KR | 10-2014-0118518 | | 10/2014 |
| KR | 10-1586230 | B | 1/2016 |
| WO | 2015136737 | A1 | 9/2015 |

OTHER PUBLICATIONS

International Preliminary Examination Authority Report, dated Dec. 11, 2018.

* cited by examiner

*Primary Examiner* — Debra M Sullivan

(57) ABSTRACT

The present invention relates to an apparatus and a method for shot peening a coil spring, and to a continuous shot peening apparatus and method for a coil spring, in which a coil spring revolves and rotates at the same time during shot peening processing to enable more uniform processing of the coil spring, and a shot peening process and a preparing process thereof are simultaneously performed through simultaneous rotation of a housing in a processing position and a housing in a preparation position, so that the inventive apparatus and method require a simpler configuration and a smaller work space for a shot peening process than those of the prior arts and can perform shot peening of many coil springs in a short period of time.

8 Claims, 7 Drawing Sheets

CONTINUOUS SHOT PEENING APPARATUS AND METHOD FOR COIL SPRING

CROSS REFERENCE TO RELATED APPLICATIONS

This application is a continuation of International Application No. PCT/KR2016/14696 filed on Dec. 15, 2016, which claims priority to Korean Application No. 10-2016-0071455 filed on Jun. 9, 2016, the entire contents of which are herein incorporated by reference in its entirety.

TECHNICAL FIELD

The present invention relates to an apparatus and a method for shot peening a coil spring, and to a continuous shot peening apparatus and method for a coil spring, in which a coil spring revolves and rotates at the same time during shot peening processing to enable more uniform processing of the coil spring, and a shot peening process and a preparing process thereof are simultaneously performed through simultaneous rotation of a housing in a processing position and a housing in a preparation position, so that the inventive apparatus and method require a simpler configuration and a smaller work space for a shot peening process than those of the prior arts and can perform shot peening of many coil springs in a short period of time.

BACKGROUND ART

In general, a process for manufacturing a coil spring includes a basic material inspection for a raw material, a surface peeling step, a heating step, a coil forming, and a quenching step.

After a primary coil spring has been manufactured as described above, a series of surface treatment steps are performed to increase mechanical properties and fatigue strength of the coil spring.

That is, after a forming step and a quenching step of the coil spring have been finished, a surface treatment is performed through a tempering step, a shot peening step, a pretreatment step, and a painting step, and a load test step, a marking step, and a final inspection step are then performed before a product is released.

In the heat treatment step and the tempering step, the coil spring is heated to a predetermined temperature, and, at the same time, an internal residual stress of the heat-treated coil spring is removed while the coil spring passes through a heating furnace and a tempering furnace in which a predetermined temperature is maintained, before the coil spring is supplied to a shot peening apparatus.

In the shot peening step, a small ball, such as a bead, made of steel, is shot and collided with the surface of the material, so as to improve mechanical properties of the material and enhance fatigue life of the material. Especially, in the shot peening step, the compressive residual stress distribution of the material can be formed to have a predetermined depth from the material surface, so as to increase the fatigue life and corrosion resistance of the material.

As illustrated in the Korean Registered Patent No. 10-0931155, a conventional shot peening process is performed by interposing a coil spring between spring clamping means facing each other in a state where the coil spring is compressed by the spring clamping means facing each other, and then rotating and shot peening the coil spring by means of a shot room apparatus, wherein the coil spring is moved by a conveyer apparatus.

However, the conventional technique as described above requires a clamping means for holding a coil spring and a conveyer for moving the coil spring, and thus complicates the apparatus and requires a large space for installation thereof.

Also, it is difficult to operate a large number of coil springs in a short time since the coil springs are moved using a conveyer.

DETAILED DESCRIPTION OF THE INVENTION

Technical Problem

The present invention has been made to solve the problems described above, and an aspect of the present invention is to provide a continuous shot peening apparatus and method for a coil spring, in which a coil spring revolves and rotates at the same time during shot peening processing to enable more uniform processing of the coil spring, and a shot peening process and a preparing process thereof are simultaneously performed through simultaneous rotation of a housing in a processing position and a housing in a preparation position, so that the inventive apparatus and method require a simpler configuration and a smaller work space for a shot peening process than those of the prior arts, can perform shot peening of many coil springs in a short period of time, and ensure uniform quality of the shot peened coil spring.

However, an aspect of the present invention is not limited to the aspects mentioned above, and other aspects according to the following means or a specific configuration in the embodiments are not mentioned, but may be clearly understood by a person skilled in the art from the description.

Technical Solution

In accordance with the above aspect, the present invention provides a continuous shot peening apparatus for a coil spring, the continuous shot peening apparatus including: a shot peening device (SP) that performs shot peening processing of a coil spring (CS); and a mounting part (10) in which the coil spring (CS) is mounted, wherein the mounting part (10) includes a plurality of housings (C), a plurality of holding units (100) disposed in the housings (C) to hold the coil spring (CS), and driving units (200) disposed in the housings (C) to cause the holding units (100) to rotate and revolve, wherein each of the driving units (200) is disposed in the housing (C) and includes a driving shaft (S2) rotated by a driving actuator (M2), a rotation unit (GU) interworking with the driving shaft (S2) to rotate the holding units (100), and a revolution unit (500) interworking with each of the driving shaft (S2) and the holding unit (100) to cause the holding units (100) to revolve.

The housings (C) include a central housing (C2) that receives a plurality of coil springs (CS) therein, and a first housing (C1) and a second housing (C3) arranged at horizontally opposite sides of the central housing (C2), respectively, wherein the holding units (100) are symmetrically arranged in the horizontal direction in the first housing (C1) and the second housing (C3), respectively, so as to hold opposite sides of the coil spring (CS) disposed in the central housing (C2), respectively, and the driving units (200) are symmetrically arranged in the horizontal direction in the first housing (C1) and the second housing (C3), respectively.

Each of the holding units (100) includes a holding part (120) to which the coil spring (CS) is fixed, and a holding shaft (110) disposed at the holding part (120) and interworking with the rotation unit (GU).

Rotation units (GU) are disposed in the first housing (C1) and the second housing (C3), respectively, and each of the rotation units includes a sun gear (210) and a plurality of planetary gears (220) arranged around and gear-coupled with the sun gear (210). The driving shaft (S2) is disposed at the sun gear (210) to enable the sun gear to interwork with the driving shaft, the planetary gears have holding shafts (110) arranged therein, respectively, to enable the planetary gears to interwork with the holding shafts, and the holding shafts (110) rotate by means of the rotation of the planetary gears (220).

Revolution units (500) include bases (540) disposed on floor surfaces of the first housing (C1) and the second housing (C3) facing the central housing (C2), and first cylinders (510), second cylinders (520), and third cylinders (530). The first cylinder (510), the second cylinder (520), and the third cylinder (530) are disposed at the base (540), have the same center, and are sequentially disposed in an outward direction. Further, the first cylinder (510), the second cylinder (520), and the third cylinder (530) each have a shape of a hollow cylinder, and have a floor surface closed by the base (540) and an opposite surface thereof opened, the driving shaft (S2) is inserted in and interworks with the first cylinder (510), the holding shaft (110) is inserted in a space between the second cylinder (520) and the third cylinder (530) and interworks with the second cylinder (520) and the third cylinder (530), the holding shaft (110) extends through a floor of the space between the second cylinder (520) and the third cylinder (530), and is inserted in the central housing (C2), the sun gear (210) is disposed on and interworks with the first cylinder (510), and the planetary gears (220) are disposed at and interwork with the second cylinder (520) and the third cylinder (530).

A bearing cover (240) is disposed at a bottom surface of the planetary gear (220) and an external side of the holding shaft (110) to interwork with the second cylinder (520) and the third cylinder (530) and interwork with the planetary gear (220).

A main shaft (S1) is disposed at one side of the housing (C), an interworking pulley (250) is rotatably disposed at an external side of the main shaft (S1) and interworks with the driving actuator (M2), and a driving pulley (260) is disposed at the driving shaft (S2) to interwork with the interworking pulley (250).

A main actuator (M1) is disposed to drive the main shaft (S1), wherein the main actuator (M1) includes a hydraulic cylinder that generates power for moving forward and backward, a rack that moves forward and backward by means of the hydraulic cylinder, and a pinion that is disposed at the main shaft (S1), and interworks with the rack so as to be rotated, and the housing (C) interworks with the main shaft (S1) so as to be rotated by 180 degrees.

The mounting part further includes moving units (300) symmetrically disposed in the first housing (C1) and the second housing (C3) in the horizontal direction to move the holding shafts (110) forward and backward, and the moving units (300) include fixing plates (330) disposed in the first housing (C1) and the second housing (C3) and to which the holding shafts (110) are fixed, moving actuators (310) that are arranged in the first housing (C1) and the second housing (C3), respectively, and generate power for moving forward and backward, and operating rods (320) disposed at the moving actuators (310), respectively, so as to move the fixing plates (330) forward and backward.

Further, the present invention provides a method of continually shot peening a coil spring by using the continuous shot peening apparatus, the method including: rotating the holding units (100) interworking with the planetary gears (220) by sequentially rotating the sun gear (210) and the planetary gears (220) due to rotation of the driving shaft (S2), and causing the planetary gears (220) and the holding unit (100) interworking with the revolution unit (500) to revolve by rotating the revolution unit (500) due to rotation of the driving shaft (S2), wherein the coil spring (CS) held by the holding units (100) is shot peened by the shot peening device (SP) while rotating and revolving.

After a shot peening treatment of the coil spring (CS) is finished, the housing (CM) in a shot peening position and the housing (CC) in a preparing position are reversely arranged by rotating the main shaft (S1) by 180 degrees. Accordingly, the housing (CC) in the preparing position is oriented toward the shot peening device (SP) side so as to process the coil spring (CS) included therein. Meanwhile, after the housing (CM) in the processing position is disposed in an opposite direction, the coil spring having been processed is discharged from the holding units (100), and a new coil spring is mounted on the holding units (100).

In order to discharge the coil spring having been processed from the holding units (100), holding parts (120) holding the coil spring (CS) are separated from the coil spring (CS) by moving the fixing plate (330) away from the coil spring (CS) by means of the moving actuator (310), and then the coil spring (CS) is discharged.

The new coil spring (CS) is disposed between the holding parts (120), and then the holding parts (120) hold the coil spring (CS) by the moving actuator (310).

Advantageous Effects

According to the present invention as described above, the inventive apparatus and method require a simpler configuration and a smaller work space for a shot peening process than those of the prior arts, and allow a housing in a processing position and a housing in a preparing position to be alternately oriented toward a shot peening device. As a result, the apparatus and method can shot-peen many coil springs in a short period of time, and can uniformly improve the fatigue life and corrosion-resistance of all parts of the coil spring.

MODE FOR CARRYING OUT THE INVENTION

Figure 1:
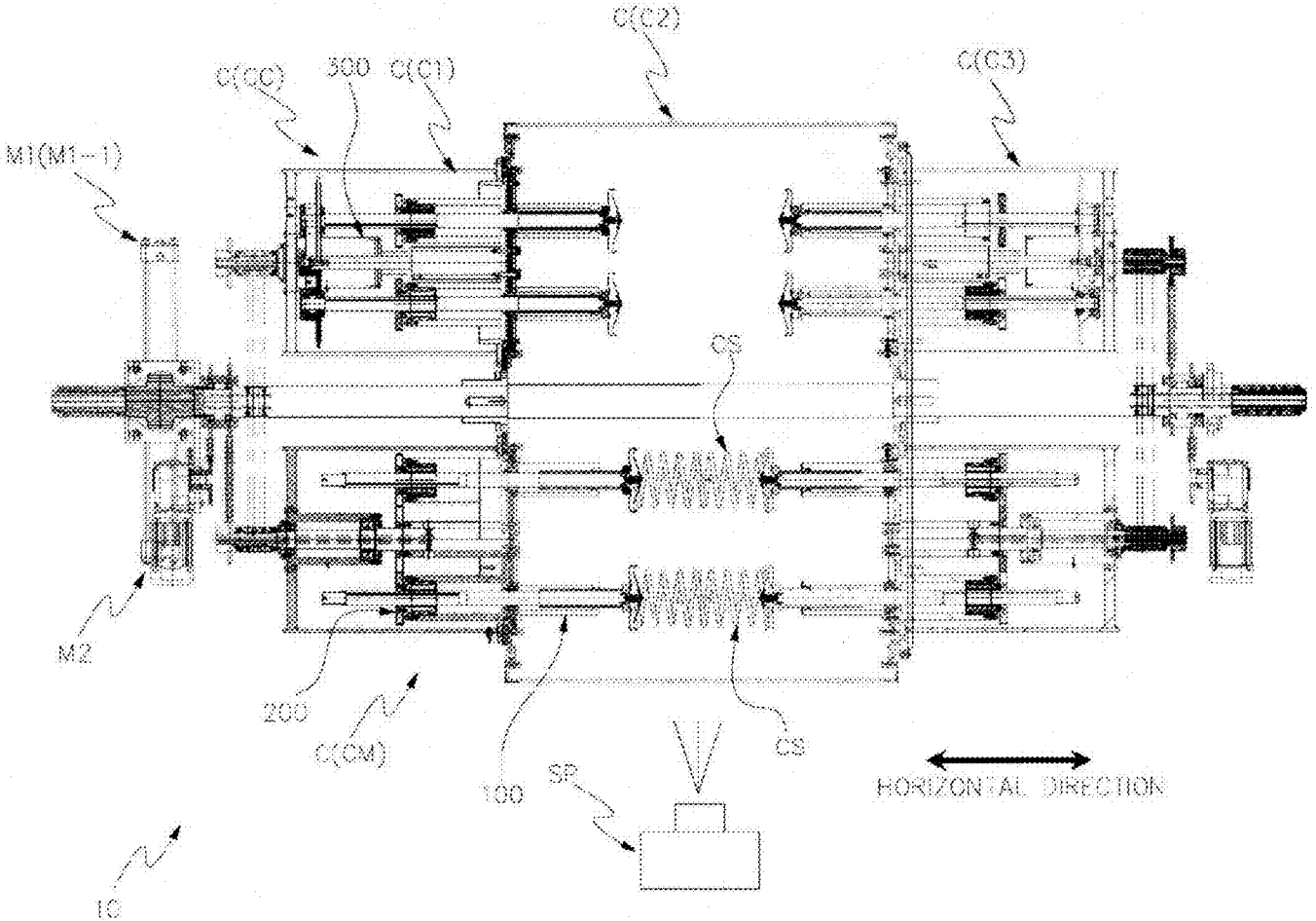
FIG. 1 is a schematic diagram illustrating a continuous shot peening apparatus according to an embodiment of the present invention.

The features and advantages of the present invention will be clearer from the following detailed description based on the accompanying drawings.

Terms or words used in the present specification and the claims should not be interpreted in a conventional and dictionary meaning, and it should be noted that technical terms used in the present specification of the present invention are merely for the purpose of describing particular embodiments and are not intended to limit the scope of the present invention on the basis of the principle in which the inventor may appropriately define the concept of the terms in order to explain their own invention in the best way.

In addition, the technical terms used in the present specification should be interpreted in a meaning generally understood by a person skilled in the technical field to which the present invention belongs unless defined as a particular other meaning in the present specification, and should not be interpreted in an excessively expansive meaning, or an excessively reduced meaning.

Furthermore, a singular form used in the specification includes a plural form unless contextual meanings of the singular form and the plural form are different. In the present application, the term "include", "comprise", or the like should not be interpreted in necessarily comprising all the various components or steps disclosed in the specification, should be interpreted in that a part of the components or a part of the steps may not be included, or additional components or steps may be further included, and should be interpreted in a meaning and a concept corresponding to the technical idea of the present invention.

As illustrated in FIGS. 1 to 7, a shot peening apparatus according to an embodiment of the present invention includes a shot peening device SP that performs shot peening processing of a coil spring CS, and a mounting part 10 in which the coil spring CS is mounted.

The shot peening device SP is widely known, and thus a repetitive description will be omitted.

The mounting part 10 includes a housing C, a holding unit 100 disposed in the housing C to hold the coil spring CS, and a driving unit 200 that is disposed in the housing C and rotates the holding unit 100.

The mounting part includes a plurality of housings C, one of the housings is disposed on an operating position of the shot peening device SP to allow shot peening processing, and the other housings are disposed at the opposite-side position thereof, and allow the processed coil spring to be ejected and a new coil spring to be mounted.

The driving unit 200 is disposed in the housing C and includes a driving shaft S2 rotated by a driving actuator M2, a rotation unit GU that interworks with the driving shaft S2 and rotates the holding unit 100, and a revolution unit 500 that interworks with each of the driving shaft S2 and the holding unit 100, so as to enable the holding unit 100 to revolve.

That is, the rotation unit GU includes a plurality of gears and has one side rotated by the driving shaft S2 and another side interworking with the holding unit 100, so that the holding unit 100 is rotated by rotation of the driving shaft S2.

A part of the revolution unit 500 interworks with the driving shaft S2 and another part thereof interworks with the holding unit 100, so that the holding unit 100 revolves when the revolution unit 500 is rotated by the driving shaft S2.

Therefore, the holding unit 100 rotates and revolves at the same time, so that it is possible to more uniformly perform shot peening processing.

The housings C include a central housing C2 that receives a plurality of coil springs CS therein, and a first housing C1 and a second housing C3 arranged at horizontally opposite sides of the central housing C2.

That is, holding units 100 and driving units 200 are symmetrically disposed in the first housing C1 and the second housing C3 with respect to the central housing C2.

As described above, the holding units 100 are rotated by the driving units 200, and are horizontally symmetrically arranged in the first housing C1, the central housing C2, and the second housing C3, so as to hold opposite sides of the coil spring CS.

The driving units 200 are symmetrically arranged in the horizontal direction with respect to the central housing C2, and are disposed in the first housing C1 and the second housing C3, respectively.

Figure 2:
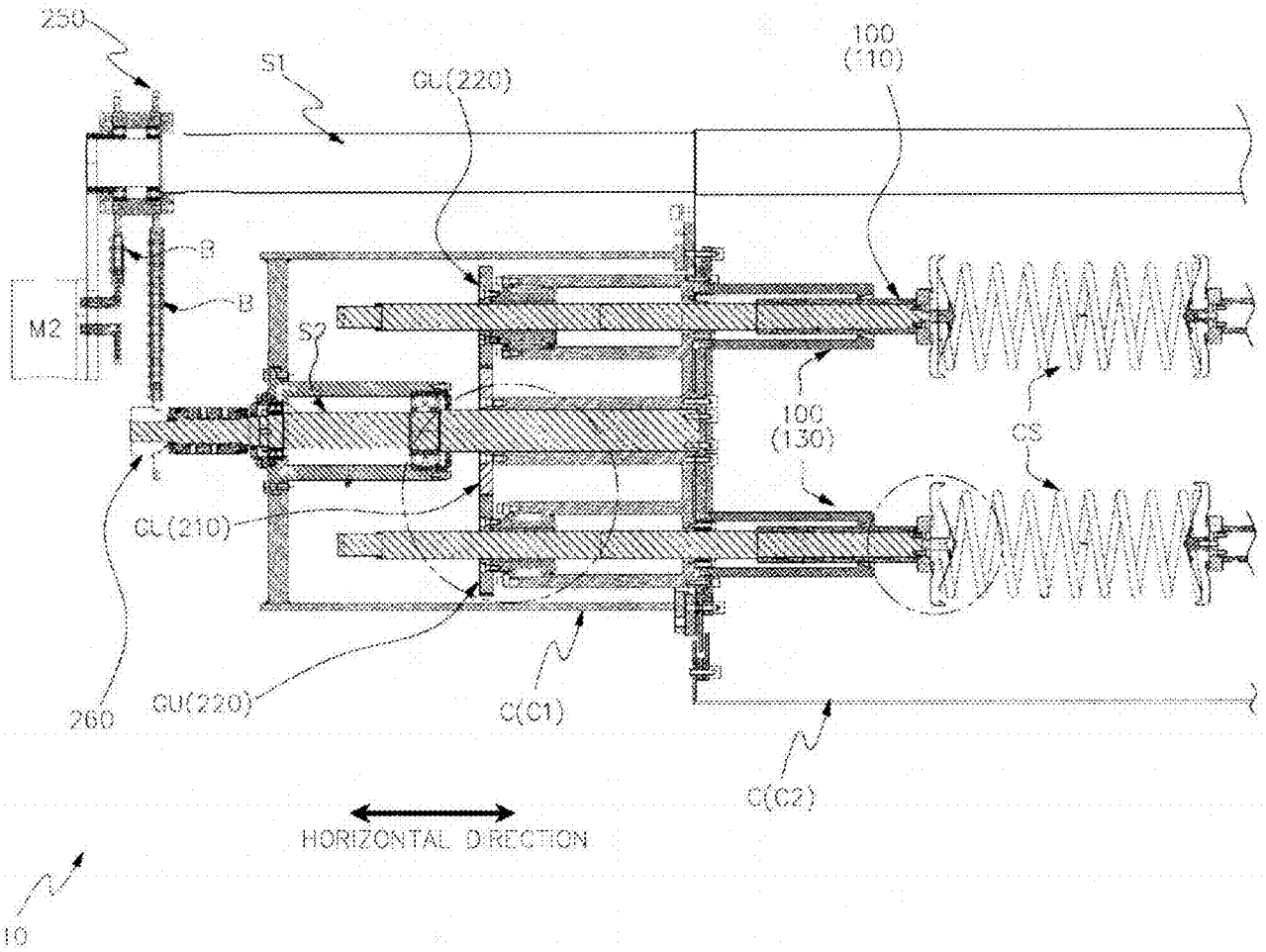
FIG. 2 is a schematic diagram illustrating only a part of a continuous shot peening apparatus according to an embodiment of the present invention.

As illustrated in FIG. 2, the holding unit 100 includes a holding part 120 to which the coil spring CS is fixed, and a holding shaft 110 that is disposed at the holding part 120 and interworks with the rotation unit GU so as to be rotated.

The holding part 120 may have various shapes as long as the holding part 120 can hold the coil spring CS, and, as illustrated, the holding shaft can have a shape in which opposite-side ends of the holding part are bent in a direction of the coil spring CS.

Also, the holding part 120 is fixed to the holding shaft 110, and a guide 130 is disposed around the holding shaft 110 so that it is possible to guide a forward and backward movement of the holding shaft 110.

Figure 3:
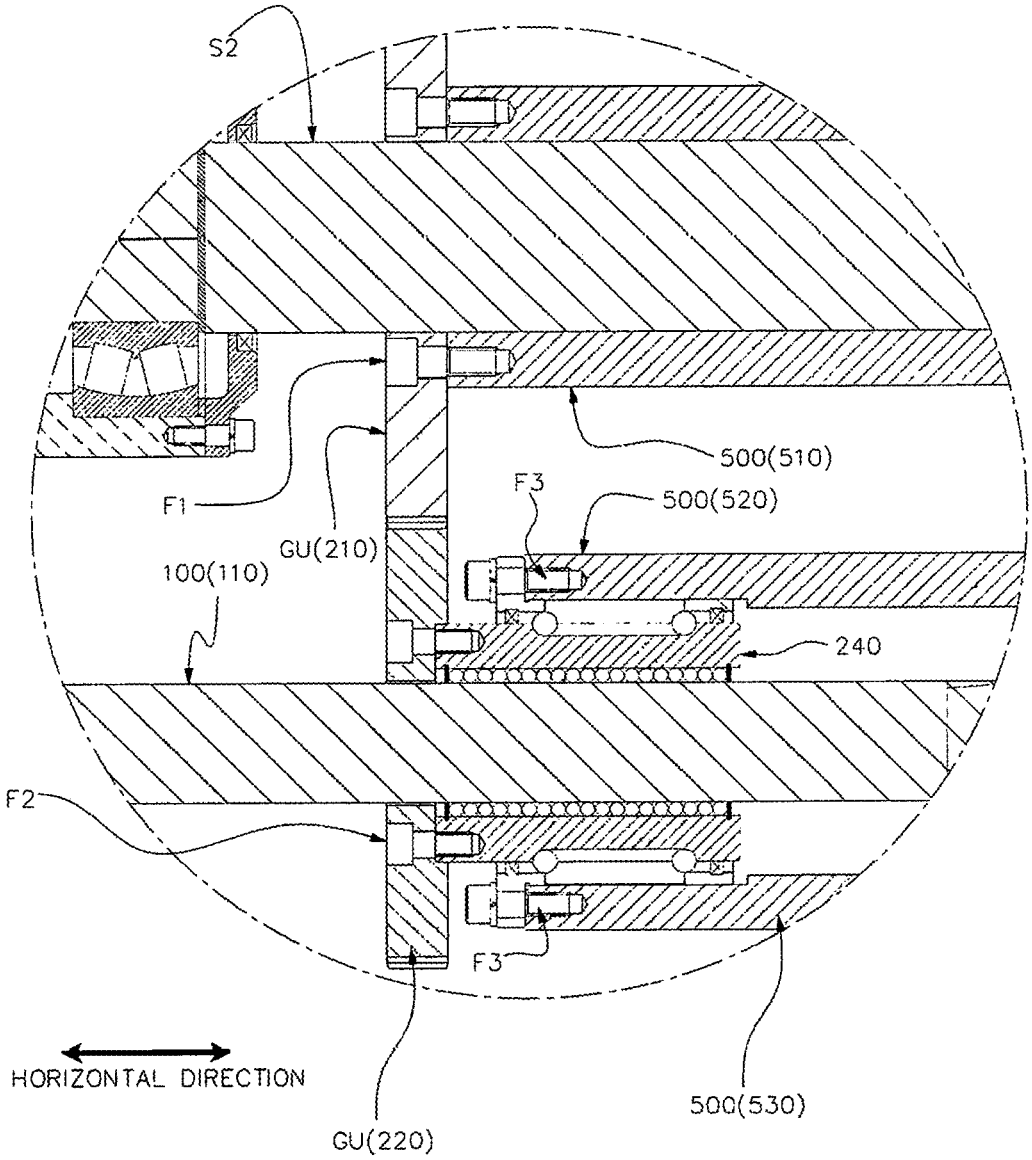
FIG. 3 is an enlarged schematic diagram illustrating only a part of a continuous shot peening apparatus according to an embodiment of the present invention.
Figure 4:
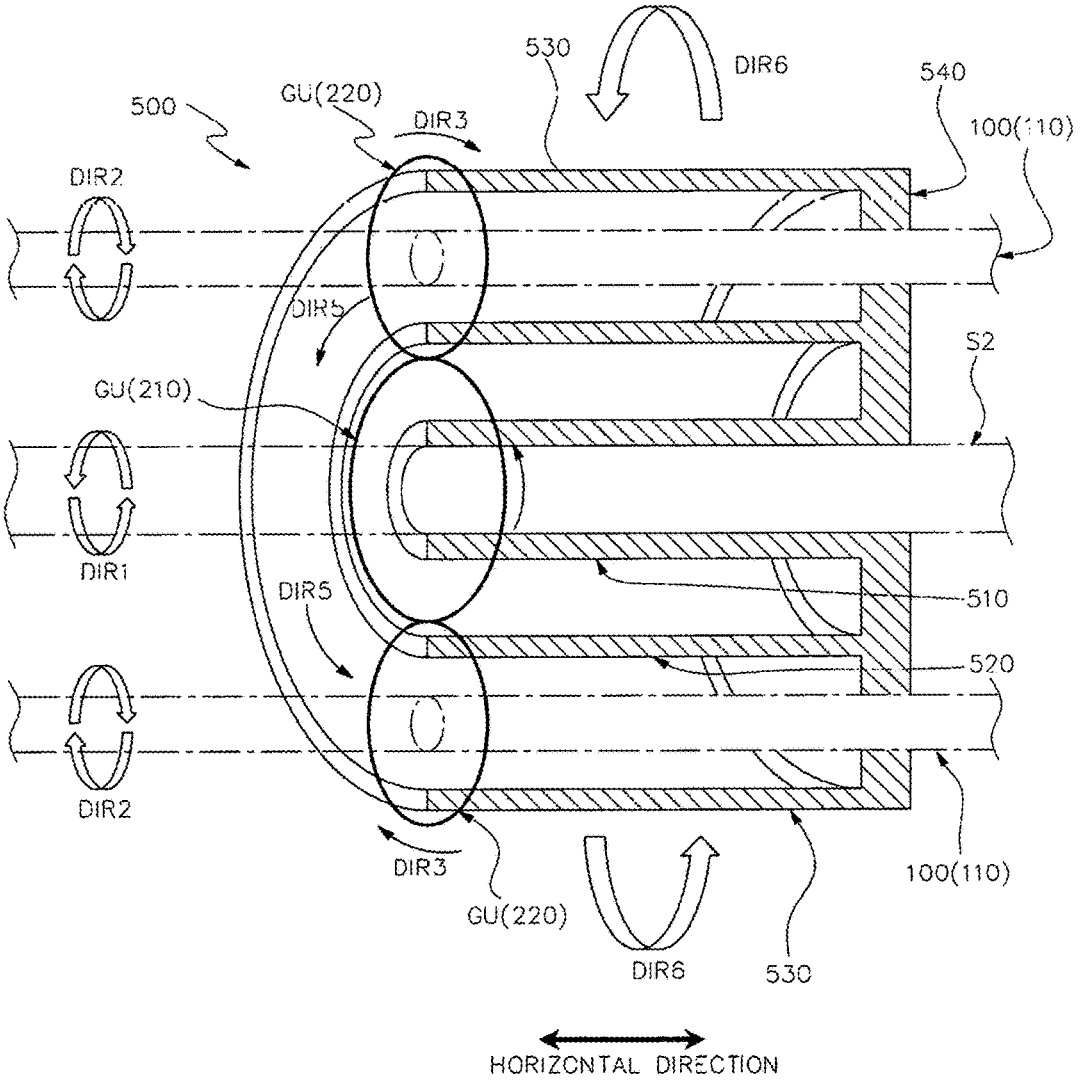
FIGS. 4 and 5 are schematic diagrams describing a relationship between a revolution unit and a rotation unit of a continuous shot peening apparatus according to an embodiment of the present invention.

As illustrated in FIGS. 2 to 4, rotation units GU are arranged in the first housing C1 and the second housing C3, respectively, and symmetrically disposed in the horizontal direction.

Hereinafter, the rotation unit GU disposed in the first housing C1 will be described.

The rotation unit GU includes a sun gear 210 interworking with the driving shaft S2, and a plurality of planetary gears 220 that are arranged at an external side of the sun gear 210 so as to interwork with the sun gear.

The holding shaft 110 is disposed in and interworks with the planetary gear 220.

That is, when the driving shaft S2 is rotated by the driving actuator M2, the sun gear 210 is rotated, and the planetary gear 220 interworking with the sun gear is thus rotated.

As a result, since the holding shaft 110 interworks with the planetary gear 220, the holding shaft 110 is also rotated, and the coil spring CS is thus rotated.

A bearing cover 240 is fixed to a lower side of the planetary gear 220, and is rotatably fixed to an external side of the holding shaft 110.

The revolution unit 500 interworks with each of the driving shaft S2 and the holding unit 100, to cause the holding unit 100 to revolve, and revolution units include bases 540 disposed on floor surfaces of the first housing C1 and the second housing C3 facing the central housing C2, and first cylinders 510, second cylinders 520, and third cylinders 530. The first cylinder 510, the second cylinder 520, and the third cylinder 530 are disposed at the base 540, have the same center, and are sequentially disposed in an outward direction.

Hereinafter, the revolution unit 500 disposed in the first housing C1 will be described in detail with reference to FIGS. 3 and 4.

Figure 5:
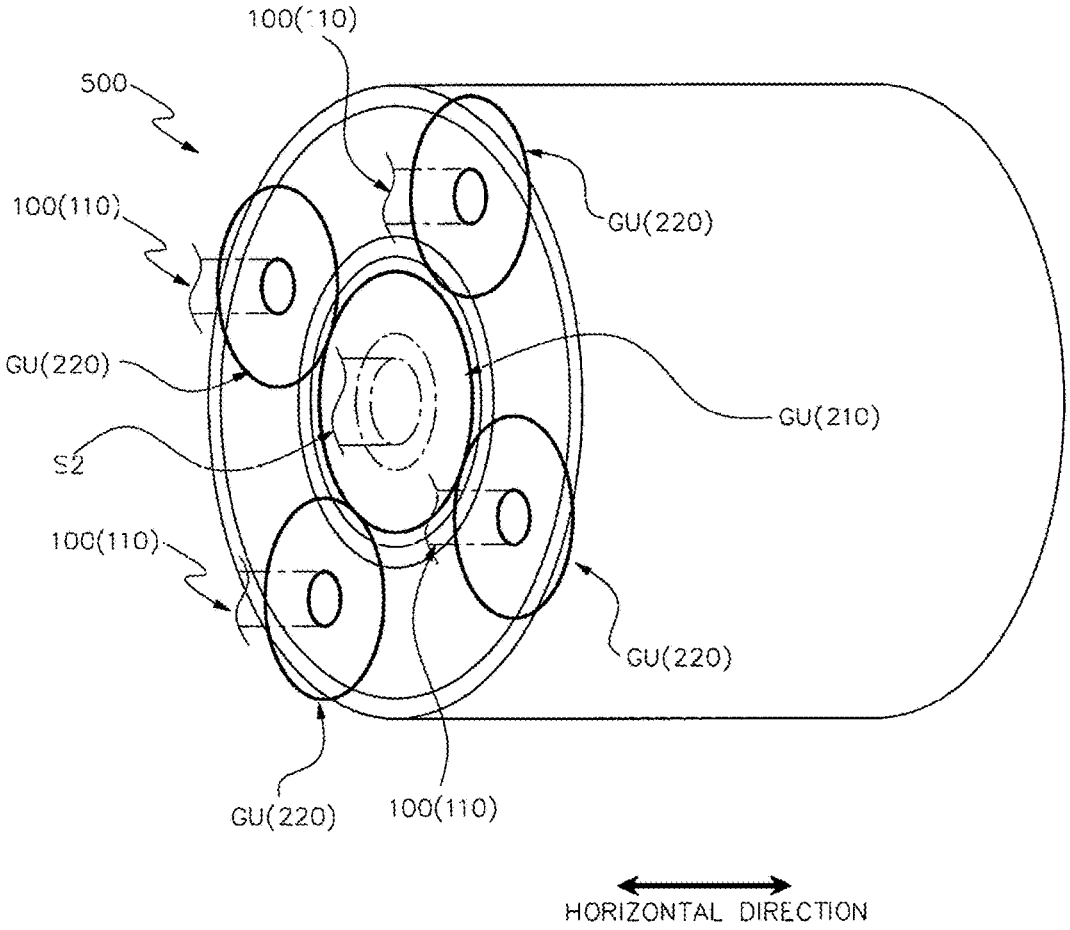

The first cylinder 510, the second cylinder 520, and the third cylinder 530 each have a shape of a hollow cylinder, and have a floor surface closed by the base 540, as described above. Also, in a case of the revolution unit 500 disposed in the first housing C1, as illustrated in FIGS. 3 to 5, the opposite surfaces, i.e., the left sides in the drawings are opened.

In addition, the driving shaft S2 is inserted in and interworks with the first cylinder 510, and the sun gear 210 is disposed on and interworks with the first cylinder 510. That is, the sun gear 210 rotates when the driving shaft S2 rotates.

Also, the sun gear 210 interworks with the first cylinder 510 by means of a fixing piece F1, and the first cylinder 510 is thus interworks with each of the sun gear 210 and the driving shaft S2, so as to be rotated.

The holding shaft 110 is inserted in a space between the second cylinder 520 and the third cylinder 530, so as to interwork with the second cylinder 520 and the third cylinder 530, and the holding shaft 110 extends through a floor of the space between the second cylinder 520 and the third cylinder 530, and is inserted in the central housing C2 to hold the coil spring.

Also, the planetary gear 220 is disposed at and interworks with the second cylinder 520 and the third cylinder 530.

To this end, as described above, a bearing cover 240 is disposed at a bottom surface of the planetary gear 220 and an external side of the holding shaft 110.

That is, the planetary gear 220 interworks with the bearing cover 240 by means of a fixing piece F2, and the bearing cover 240 interworks with each of the second cylinder 520 and the third cylinder 530 by means of fixing pieces F3.

A separate bearing is disposed between the second cylinder 520 and the third cylinder 530, so that the bearing cover 240 may be disposed to be rotatable.

That is, when the entire revolution unit 500 is rotated by rotation of the sun gear 210, the second cylinder 520 and the third cylinder 530 are rotated, and the holding shaft 110 interworking with the cylinders thus revolves.

Also, the planetary gear 220 is gear-coupled with the sun gear 210, and is thus rotated by interworking with rotation of the sun gear 210, and the holding shaft 110 also rotates.

Therefore, the planetary gear 220 and the holding shaft 110 interworking with the planetary gear 220 rotate and revolve at the same time.

As illustrated in FIG. 4, when the driving shaft S2 rotates in a counterclockwise direction DIR1, each of the sun gear 210 and the revolution unit 500 rotates in counterclockwise directions DIR4 and DIRE.

The holding shaft 110 revolves in a clockwise direction DIR5 by the rotation of the revolution unit 500.

Therefore, the planetary gear 220 interworking with the holding shaft 110 also revolves in the clockwise direction DIR5.

Since the planetary gear 220 interworks with the sun gear 210 and thus rotates, both of the planetary gear 220 and the holding shaft 110 not only revolve but also rotate.

As a result, the coil spring CS fixed to the holding shaft 110 not only revolves but also rotates.

As illustrates in FIG. 5, a plurality of holding shafts 110 (for example, four shafts) may be arranged around the sun gear 210.

This configuration enables a plurality of coil springs to be processed at once.

As illustrated in FIG. 2, in order to rotate the driving shaft S2, an interworking pulley 250 is disposed at a main shaft S1 installed at one side of the housing C, i.e., the first housing C1 or the second housing C3.

The interworking pulley 250 is mounted on a bearing installed at an external side of the main shaft S1, so that the interworking pulley 250 is rotatable in a state where the main shaft S1 stops, and the interworking pulley interworks with the driving actuator M2 by a power transfer part B.

A driving pulley 260 is fixed to the driving shaft S2, and the driving pulley 260 interworks with the interworking pulley 250 by means of the power transfer part B.

That is, the power transfer part B transfers power generated by the driving actuator M2 to rotate the interworking pulley 250, and the interworking pulley 250 interworks with the driving pulley 260 through the power transfer part B. Therefore, a rotational force of the interworking pulley 250 is finally transferred to the driving pulley 260, so as to rotate the driving shaft S2.

The power transfer part B may perform a belt transfer scheme, a chain transfer scheme, or the like, but a coil spring to be shot-peened in the present invention doesn't need to rotate and revolve at a high speed. Therefore, the driving shaft S2 is naturally operated at a low speed and it is thus preferable to adopt the chain transfer scheme, like the embodiment illustrated in FIG. 2. In this embodiment, the power of the driving actuator M2 rotates, by means of a chain, an interworking wheel mounted on the main shaft S1 in a state where the main shaft S1 stops and a rotational force of the interworking wheel is transferred to a driving wheel fixed to the driving shaft S2 by means of the chain, so as to rotate the driving shaft S2.

A main actuator M1 is disposed to drive the main shaft S1, wherein the main actuator M1 includes a hydraulic cylinder M1-1 that generates power for moving forward and backward, a rack that is moved forward and backward by means of the hydraulic cylinder M1-1, and a pinion that is disposed at the main shaft S1, and interworks with the rack.

That is, when the rack is moved forward and backward by the hydraulic cylinder M1-1, the pinion interworking with the rack is rotated. The main shaft S1 is rotated by the rotating pinion.

The housing C interworks with the main shaft S1, and is thus rotated by 180 degrees.

That is, multiple housings C are arranged as described above, one housing CM of the housings is disposed in the processing position oriented toward a shot peening side, and the other housings CC are disposed at a preparing position which is an opposite side thereof.

When processing of the coil spring received in the housing CM disposed in the processing position has finished, the housing CM disposed in the processing position and the housing CC disposed in the preparing position exchange their positions with each other by 180 degrees rotation of the main shaft S1.

Accordingly, the coil spring received in the housing newly disposed in the processing position is shot-peened, and, at the same time, the coil spring having been processed is ejected from the preparing position and then a new coil spring is mounted.

That is, according to the present invention, a plurality of coil springs can be simultaneously processed, and a processing process and a preparing process can be simultaneously performed, thereby improving processing efficiency. Further, multiple housings are used while rotating, thereby reducing a work space.

As illustrated in FIG. 2, a housing interworking part at which a part of the housing C is connected to the main shaft S1 is disposed in order to interwork the main shaft S1 with the housing C.

The housing interworking part may have various shapes as long as the housing interworking part can connect between the main shaft S1 and the housing C.

Figure 6:
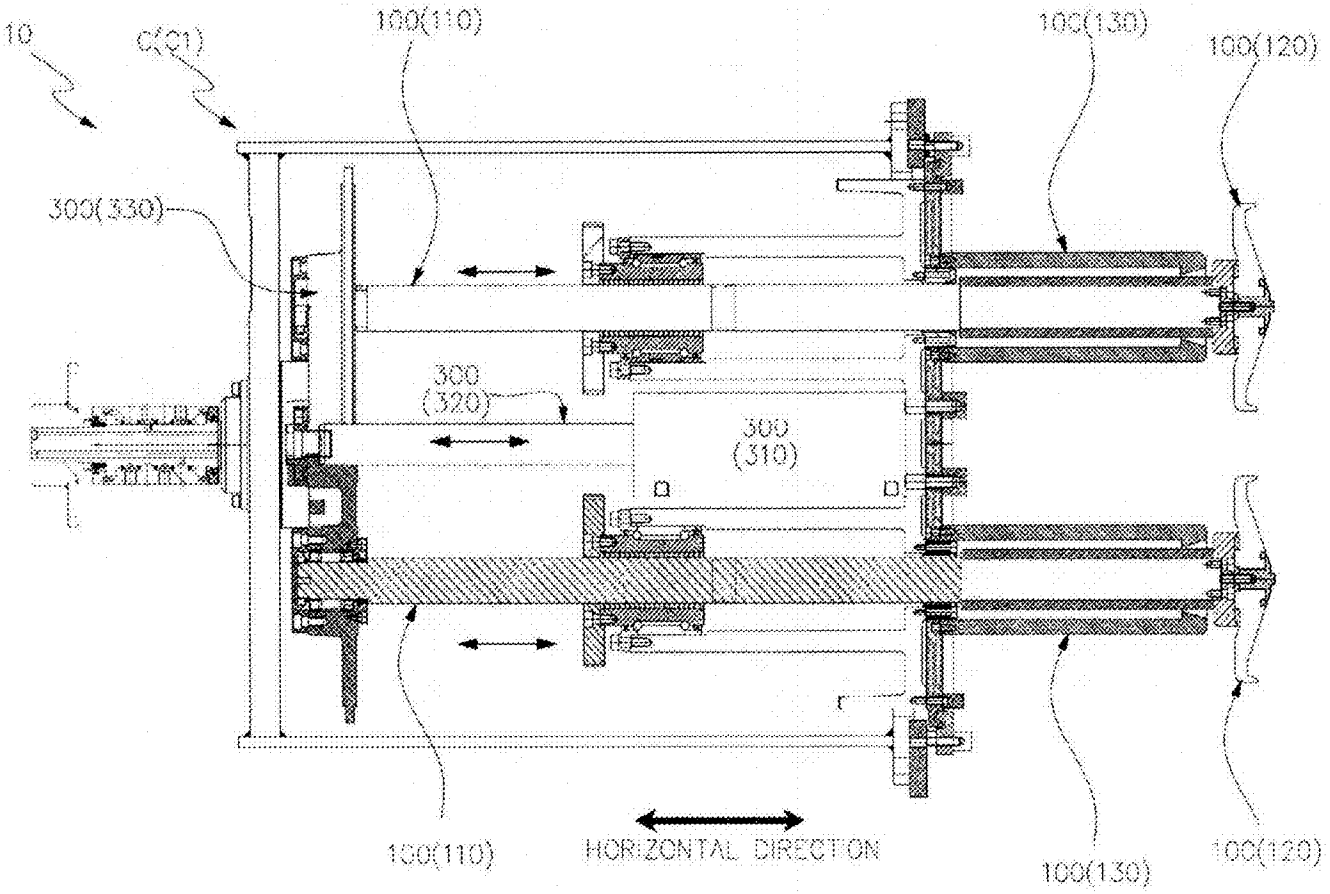
FIG. 6 is a schematic diagram describing a moving unit of a continuous shot peening apparatus according to an embodiment of the present invention.

As illustrated in FIGS. 1 and 6, the continuous shot peening apparatus for a coil spring according to the present invention has a moving unit 300 which lifts and lowers the holding shaft 110.

Moving units 300 having the same configuration are arranged in the first housing C1 and the second housing C3, respectively, and are symmetrical in the horizontal direction.

Hereinafter, a moving unit disposed in the first housing C1 will be described.

The moving unit 300 includes a fixing plate 330 disposed in the first housing C1 and to which the holding shaft 110 is fixed, and a moving actuator 310 that is disposed in the first housing C1 and generates power for moving forward and backward.

An operating rod 320 is disposed at the moving actuator 310 and moves the fixing plate 330 forward and backward.

That is, when a length of the operating rod 320 increases toward a left side in the drawing, the fixing plate 330 moves in a left-side direction in the drawing, and the holding shaft 110 thus moves to the left side in the drawing.

Also, the holding shaft 110 moves in an opposite direction thereof by means of the moving unit 300 disposed in the second housing C3, so that the coil spring CS is separated from the holding part 120 installed at the holding shaft 110.

By the moving units 300 as described above, the coil spring CS is separated from the holding units 100, and the coil spring is ejected by using a configuration such as a robot arm.

The holding part 120 may have various configurations as long as the holding part 120 can be fixed to the holding shaft 110.

The moving units 300 are arranged at opposite sides of the coil spring CS, respectively, as described above, to adjust a distance between holding parts 120 to be shorter than a length of the coil spring CS, so that a stress shot peening may progress in a state where the coil spring has been compressed.

Figure 7:
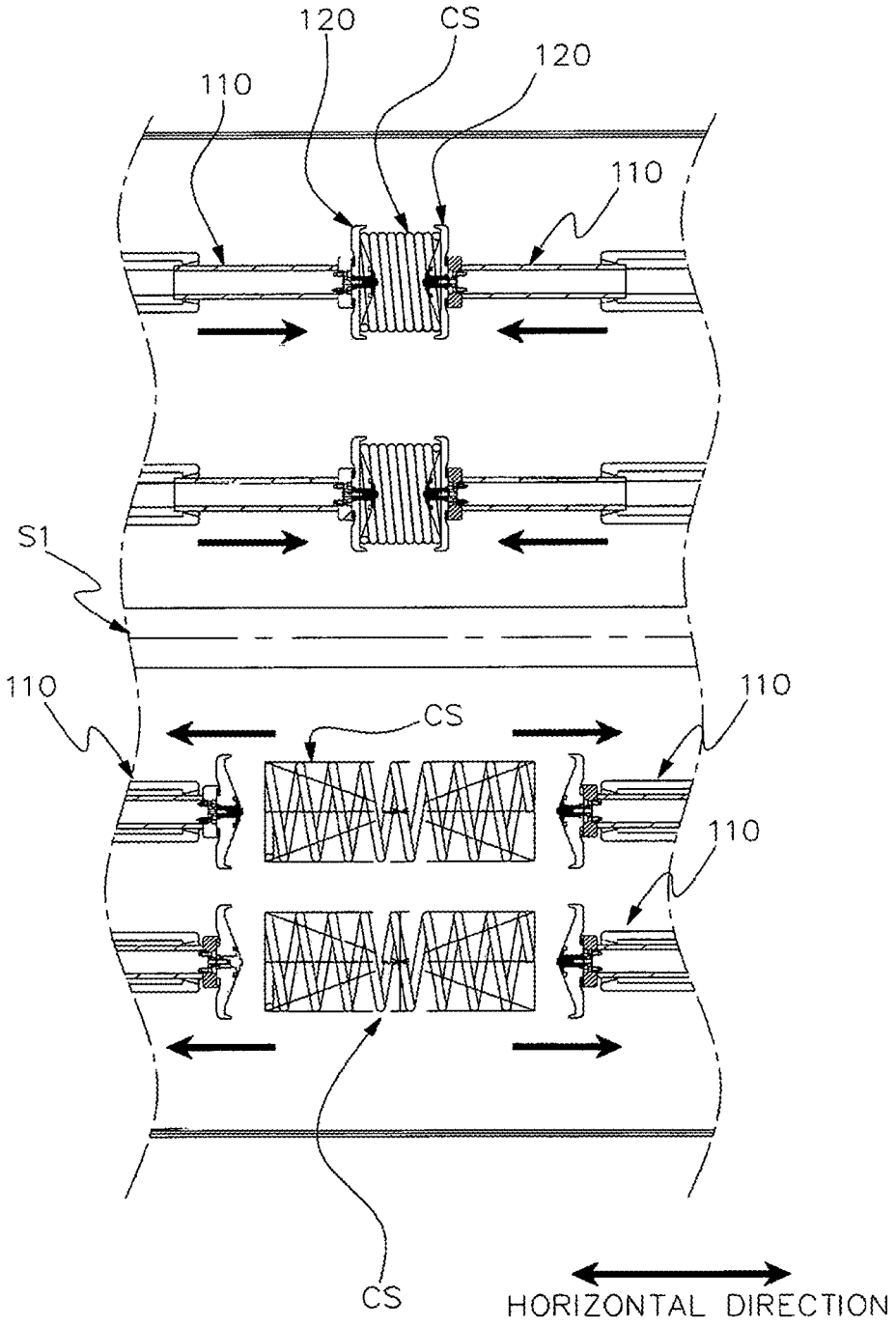
FIG. 7 is a schematic diagram in which stress shot peening is performed by a continuous shot peening apparatus according to an embodiment of the present invention.

That is, as illustrated in a left side of FIG. 7, the opposite holding shafts 110 move in the central direction of the coil spring CS so as to compress the coil spring CS between the holding parts 120, and the compressed coil is stress-shot-peened, so that an internal stress of the coil spring can be further increased.

On the contrary, in order to eject or mount the coil spring CS, the coil spring CS is separated from the holding part 120 of the holding shaft 110 by moving the holding shaft 110 in an opposite direction thereof.

Hereinafter, a method of shot peening a coil spring by using the continuous shot peening apparatus of the present invention, as described with reference to the FIGS. 1 to 7, will be described.

As illustrated in FIG. 1, a coil spring CS is shot peened since the housing CM in the processing position is oriented toward the shot peening device SP.

Also, the housing CC in the preparing position is disposed to be opposite to the housing CM in the processing position, the coil spring having been processed is ejected from the housing in the preparing position, and a new coil spring is mounted in the housing in the preparing position.

After that, the housing CC in the preparing position is oriented toward the shot peening device SP by rotating the housing by 180 degrees, so as to allow shot peening processing, and the coil spring received in the housing CM, which has been located in the processing position, is ejected.

To this end, firstly, the holding unit 100 interworking with the planetary gear 220 is rotated by sequentially rotating the sun gear 210 and the planetary gear 220 due to rotation of the driving shaft S2 in the housing CM in the processing position, and, meanwhile, the planetary gear 220 and the holding unit 100, which interwork with the revolution unit 500, revolve by rotating the revolution unit 500 due to rotation of the driving shaft S2.

As a result, while the holding unit 100 rotates and revolves at the same time, the coil spring CS is shot peened by the shot peening device SP.

After a shot peening treatment of the coil spring CS is finished in the housing CM in the processing position, the housing CC in the preparing position is oriented toward the shot peening device SP side by rotating the main shaft S1 by 180 degrees, so that the coil spring CS included therein is processed.

Also, the housing CM which has been located in the processing position changes its position to an opposite side thereof, i.e., the preparing position in which the housing CC has been located.

At this time, the coil spring which has been processed is discharged from the holding units 100 by a robot arm, and a new coil spring is mounted at the holding units 100 by the robot arm.

Also, in order to discharge the processed coil spring from the holding unit 100, the holding parts 120 installed at opposite sides of the coil spring CS are separated from the coil spring CS by moving the fixing plate 330 away from the coil spring CS by means of the moving actuator 310, and then the coil spring CS is discharged.

After that, a new coil spring CS is disposed between the holding parts 120 arranged in the horizontal direction, and then the moving actuator 310 enables the holding part 120 to hold opposite sides of the coil spring CS, so that shot peening processing is performed after the coil spring is disposed at a shot peening device side.

According to the present invention as described above, a coil spring can be continuously processed.

Embodiments of the present invention have been described above in detail with reference to the accompanying drawings. However, a person skilled in the technical field to which the present invention belongs may understand that the present invention may be implemented as other particular embodiments without modifying the technical idea or essential feature of the present invention.

Therefore, it should be understood that the embodiments described above is exemplary in all aspects, not limited, and the scope of the present invention described in the detail description is indicated by the following claims and it should be interpreted that the meanings and scopes of the claims and all the modifications and changes derived from the same concept thereof are included in the scope of the present invention.

What is claimed is:

1. A continuous shot peening apparatus for a coil spring, the apparatus comprising:

a shot peening device (SP) configured to perform shot peening processing of the coil spring (CS); and a mounting part (10) in which the coil spring (CS) is mounted, wherein the mounting part (10) comprises: a shot peening housing module (CM) is located at a shot peening position; and a preparation housing module (CC) is located at a preparing position and having substantially the same structure as the shot peening housing module (CM), wherein the shot peening housing module (CM) and the preparation housing module (CC) are arranged in parallel to each other in a first direction, wherein the shot peening housing module (CM) includes:

a first shot peening housing (C1);

a central shot peening housing (C2) receiving the coil spring (CS);

a second shot peening housing (C3) having substantially the same structure as the first shot peening housing (C1) and arranged symmetrical to the first shot peening housing (C1) with respect to the central shot peening housing (C2), wherein the first shot peening housing (C1), the central shot peening housing (C2), and the second shot peening housing (C3) are arranged in a second direction and coupled to each other to form the shot peening housing module (CM), wherein the second direction is perpendicular to the first direction;

a first holding unit (100) disposed in the central shot peening housing (C2) and configured to hold a first end of the coil spring (CS);

a first driving unit (200) provided in the first shot peening housing (C1), coupled to the first holding unit (100), and rotating and revolving the first holding unit (100):

a second holding unit (100) disposed in the central shot peening housing (C2), having substantially the same structure as the first holding unit (100), arranged symmetrical to the first holding unit (100) with respect to the coil spring (CS), and configured to hold a second end of the coil spring (CS); and a second driving unit (200) provided in the second shot peening housing (C3), having substantially the same structure as the first driving unit (200), arranged symmetrical to the first driving unit (200) with respect to the central shot peening housing (C2), coupled to the second holding unit (100), and rotating and revolving the second holding unit (100), wherein the preparation housing module (CC) comprises:

a first preparation housing (C1);

a central preparation housing (C2); and a second preparation housing (C3) having substantially the same structure as the first preparation housing (C1) and arranged symmetrical to the first preparation housing (C1) with respect to the central preparation housing (C2), wherein the first preparation housing (C1), the central preparation housing (C2), and the second preparation housing (C3) are arranged in the second direction and coupled to each other to form the preparation housing module (CM), wherein the first driving unit (200) comprises a first driving shaft (S2), a first driving actuator (M2), a first rotation unit (GU), and a first revolution unit (500), wherein the first driving shaft (S2) is configured to be rotated by the first driving actuator (M2), wherein the first rotation unit (GU) interworks with the first driving shaft (S2) to rotate the first holding unit (100), wherein the first revolution unit (500) interworks with the first driving shaft (S2) and the first holding unit (100) to revolve the first holding unit (100).

2. The continuous shot peening apparatus for a coil spring of claim 1, wherein the first holding unit (100) comprises:

a first holding part (120) to which the coil spring (CS) is fixed; and a first holding shaft (110) coupled to the first holding part (120) and interworking with the first rotation unit (GU).

3. The continuous shot peening apparatus for a coil spring of claim 2, wherein first rotation unit (GU) is disposed in the first shot peening housing (C1), wherein the first rotation unit (GU) comprises a first sun gear (210) and first planetary gears (220), wherein the first planetary gears (220) are arranged around the first sun gear (210) and are gear-coupled with the first sun gear (210), wherein the first driving shaft (S2) is coupled to the first sun gear (210) and interworks with the first sun gear (210), wherein the first planetary gears (220) are coupled to the first holding shaft (110) and interworks with the first holding shaft (110), wherein the first holding shaft (110) rotates upon rotation of the first planetary gears (220).

4. The continuous shot peening apparatus for a coil spring of claim 1, wherein the first revolution unit (500) comprises: a first base (540) disposed at a floor surface of the first shot peening housing (C1); a first cylinder (510); a second cylinder (520); and a third cylinder (530), wherein each of the first cylinder (510), the second cylinder (520), and the third cylinder (530) is in a hollow cylinder shape, has a top which is open, and has a bottom enclosed by the first base (540), wherein the first cylinder (510), the second cylinder (520), and the third cylinder (530) are arranged in a concentric manner such that the first cylinder (510) is provided at the inner-most location, the third cylinder (530) is provided at the outer-most location, and the second cylinder (520) is located between the first cylinder (510) and the third cylinder (530), wherein the first driving shaft (S2) is inserted in between the first cylinder (510) and the second cylinder (520) and interworks with the first cylinder (510), wherein a first holding shaft (110) is inserted in between the second cylinder (520) and the third cylinder (530) and interworks with the second cylinder (520) and the third cylinder (530), wherein the first holding shaft (110) extends from between the second cylinder (520) and the third cylinder (530) through the first base (540) into the central shot peening housing (C2), wherein a first sun gear (210) is disposed on and interworks with the first cylinder (510), wherein first planetary gears (220) are disposed over the second cylinder (520) and the third cylinder (530) and interwork with the second cylinder (520) and the third cylinder (530).

5. The continuous shot peening apparatus for a coil spring of claim 4, further comprising:

a first bearing cover (240) disposed between the first planetary gears (220) and the first holding shaft (110) and interworking with the second cylinder (520), wherein the third cylinder (530) interworks with the first planetary gears (220).

6. The continuous shot peening apparatus for a coil spring of claim 1, further comprising:

a main shaft (S1) disposed between the shot peening housing (CM) and the preparation housing (CC);

an interworking pulley (250) rotatably disposed at an external side of the main shaft (S1) and interworking with the first driving actuator (M2); and a driving pulley (260) fixed to the first driving shaft (S2) to interwork with the interworking pulley (250).

7. The continuous shot peening apparatus for a coil spring of claim 6, further comprising:

a main actuator (M1) configured to drive the main shaft (S1), wherein the main actuator (M1) comprises:

a hydraulic cylinder which moves forward and backward to generate power, a rack configured to move forward and backward by the hydraulic cylinder, and a pinion disposed at the main shaft (S1) and interworking with the rack so as to be rotated, wherein the shot peeing housing (CM) and the preparation housing (CC) interworks with the main shaft (S1) and are rotated by 180 degrees to switch their locations to each other.

8. The continuous shot peening apparatus for a coil spring of claim 1, further comprising:

first and second moving units (300), which are symmetrically disposed in the first shot peening housing (C1) and the second shot peening housing (C3), respectively, moving a first holding shaft (110) forward and backward, wherein the first moving unit (300) comprises:

a first fixing plate (330) disposed in the first housing (C1), wherein the first holding shaft (110) is fixed to the first fixing plate (330);

a first moving actuator (310) arranged in the first shot peening housing (C1), wherein the first moving actuator (310) moves forward and backward to generate power; and a first operating rod (320) disposed at the first moving actuator (310) and moving the first fixing plate (330) forward and backward.

* * * * *